US009375631B2

(12) United States Patent
Ferraro

(10) Patent No.: US 9,375,631 B2
(45) Date of Patent: Jun. 28, 2016

(54) SKI POLE LOCKING DEVICE

(71) Applicant: Salvatore Ferraro, Rockaway, NJ (US)

(72) Inventor: Salvatore Ferraro, Rockaway, NJ (US)

( * ) Notice: Subject to any disclaimer, the term of this patent is extended or adjusted under 35 U.S.C. 154(b) by 168 days.

(21) Appl. No.: 14/080,593

(22) Filed: Nov. 14, 2013

(65) Prior Publication Data

US 2015/0128665 A1 May 14, 2015

(51) Int. Cl.

| | |
|---|---|
| ***A63C 11/00*** | (2006.01) |
| ***A63C 11/22*** | (2006.01) |
| *E05B 73/02* | (2006.01) |

(52) U.S. Cl.

CPC ..... *A63C 11/005* (2013.01); *A63C 11/228* (2013.01); *E05B 73/02* (2013.01); *Y10T 70/40* (2015.04); *Y10T 70/402* (2015.04)

(58) Field of Classification Search

CPC ..... E05B 73/02; E05B 73/00; E05B 73/0005; E05B 73/0041; A63C 11/004; A63C 11/005; A63C 11/006; A63C 11/22; A63C 11/228; A63C 11/24; A63C 11/00

See application file for complete search history.

(56) References Cited

U.S. PATENT DOCUMENTS

| | | | | | |
|---|---|---|---|---|---|
| 924,824 | A * | 6/1909 | Peebler | 70/15 | |
| 1,907,655 | A * | 5/1933 | Parris | A45F 5/02 24/3.6 | |
| 3,354,675 | A * | 11/1967 | Quigg | 70/58 | |
| 3,667,259 | A * | 6/1972 | Reque et al. | 70/14 | |
| 4,953,892 | A * | 9/1990 | Adkins | 280/814 | |
| 5,083,813 | A * | 1/1992 | Adkins | 280/821 | |
| 5,472,101 | A * | 12/1995 | Ahrens | 211/70.5 | |
| 6,092,402 | A * | 7/2000 | Porcelli et al. | 70/18 | |
| 8,482,414 | B2 * | 7/2013 | Leyden et al. | 340/572.9 | |
| 8,973,946 | B2 * | 3/2015 | Carr | 280/824 | |
| 2011/0120197 | A1 * | 5/2011 | Molesan et al. | 70/58 | |

FOREIGN PATENT DOCUMENTS

| | | | |
|---|---|---|---|
| DE | 2556352 | A1 * | 6/1977 |
| FR | 2627999 | A1 * | 9/1989 |
| WO | WO 2004041375 | A1 * | 5/2004 |

* cited by examiner

*Primary Examiner* — Paul N Dickson
*Assistant Examiner* — Steve Clemmons
(74) *Attorney, Agent, or Firm* — Dunlap, Bennett & Ludwig PLLC

(57) ABSTRACT

A ski pole locking device may include a pole ring comprising a first moveable arm and a second moveable arm, wherein the first moveable arm comprises a catching mechanism, wherein the second moveable arm comprises a catching mechanism cavity, wherein the pole ring comprises a closed configuration and an open configuration, wherein the closed configuration comprises the catching mechanism engaged with the catching mechanism cavity, wherein the open configuration comprises the catching mechanism separated from the catching mechanism cavity; and a lock ring comprising a closed ring configuration. The ski pole locking device may be engaged on a ski pole while the pole ring is in the closed configuration around the ski pole. Once locked on the ski pole the locking device cannot be removed.

5 Claims, 3 Drawing Sheets

SKI POLE LOCKING DEVICE

BACKGROUND OF THE INVENTION

The present invention relates to ski poles and, more particularly, to a locking device for ski poles.

Currently, at ski resorts, when a person goes inside leaving their ski and poles outside, the skis may be locked, but the poles do not have a way to lock. People will walk by and steal just the ski poles. Other locking devices do not have the poles attached to the locking device and therefore must be carried separately. This device is attached to the ski poles so the locking device cannot be left behind or forgotten.

As can be seen, there is a need for a device that attaches ski poles to skis and to any permanent object with the ability to lock the ski poles.

SUMMARY OF THE INVENTION

In one aspect of the present invention, a ski pole locking device comprises: a pole ring comprising a first moveable arm and a second moveable arm, wherein the first moveable arm comprises a catching mechanism, wherein the second moveable arm comprises a catching mechanism cavity, wherein the pole ring comprises a closed configuration and an open configuration, wherein the closed configuration comprises the catching mechanism engaged with the catching mechanism cavity, wherein the open configuration comprises the catching mechanism separated from the catching mechanism cavity; and a lock ring comprising a closed ring configuration.

In another aspect of the present invention, a method of preparing a ski pole for securing comprises: spreading a pole ring of a ski pole locking device comprising the pole ring which comprises a first moveable arm and a second moveable arm, wherein the first moveable arm comprises a catching mechanism, wherein the second moveable arm comprises a catching mechanism cavity, wherein the pole slot comprises a closed configuration and an open configuration, wherein the closed configuration comprises the catching mechanism engaged with the catching mechanism cavity, wherein the open configuration comprises the catching mechanism separated from the catching mechanism cavity, and a lock ring comprising a closed ring configuration, around a ski pole; and snapping the catching mechanism and catching mechanism cavity in place into a closed configuration once the pole slot of the ski pole locking device is fully around the ski pole, wherein the locking device cannot be further opened or removed.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention may provide a ski pole locking device may include a pole ring comprising a first moveable arm and a second moveable arm, wherein the first moveable arm comprises a catching mechanism, wherein the second moveable arm comprises a catching mechanism cavity, wherein the pole ring comprises a closed configuration and an open configuration, wherein the closed configuration comprises the catching mechanism engaged with the catching mechanism cavity, wherein the open configuration comprises the catching mechanism separated from the catching mechanism cavity; and a lock ring comprising a closed ring configuration. The ski pole locking device may be engaged on a ski pole while the pole ring is in the closed configuration around the ski pole. Once locked on the ski pole the locking device cannot be removed.

Figure 1:
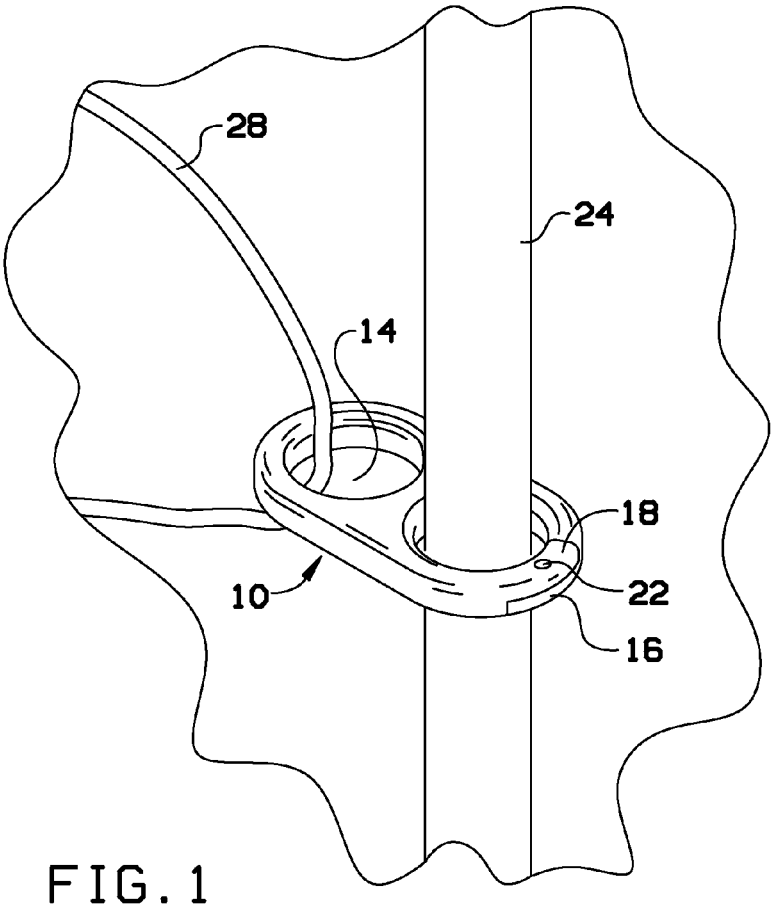
FIG. 1 is a perspective view of an exemplary embodiment of the present invention, shown in use.
Figure 2:
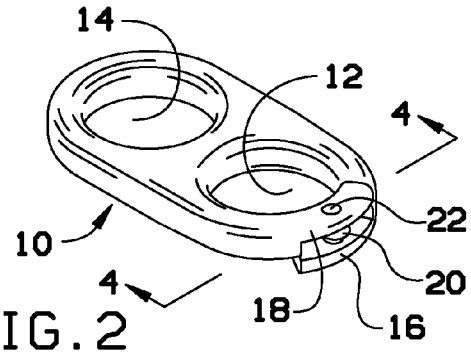
FIG. 2 is a perspective view of an exemplary embodiment of the present invention, shown in an unlocked position.
Figure 3:
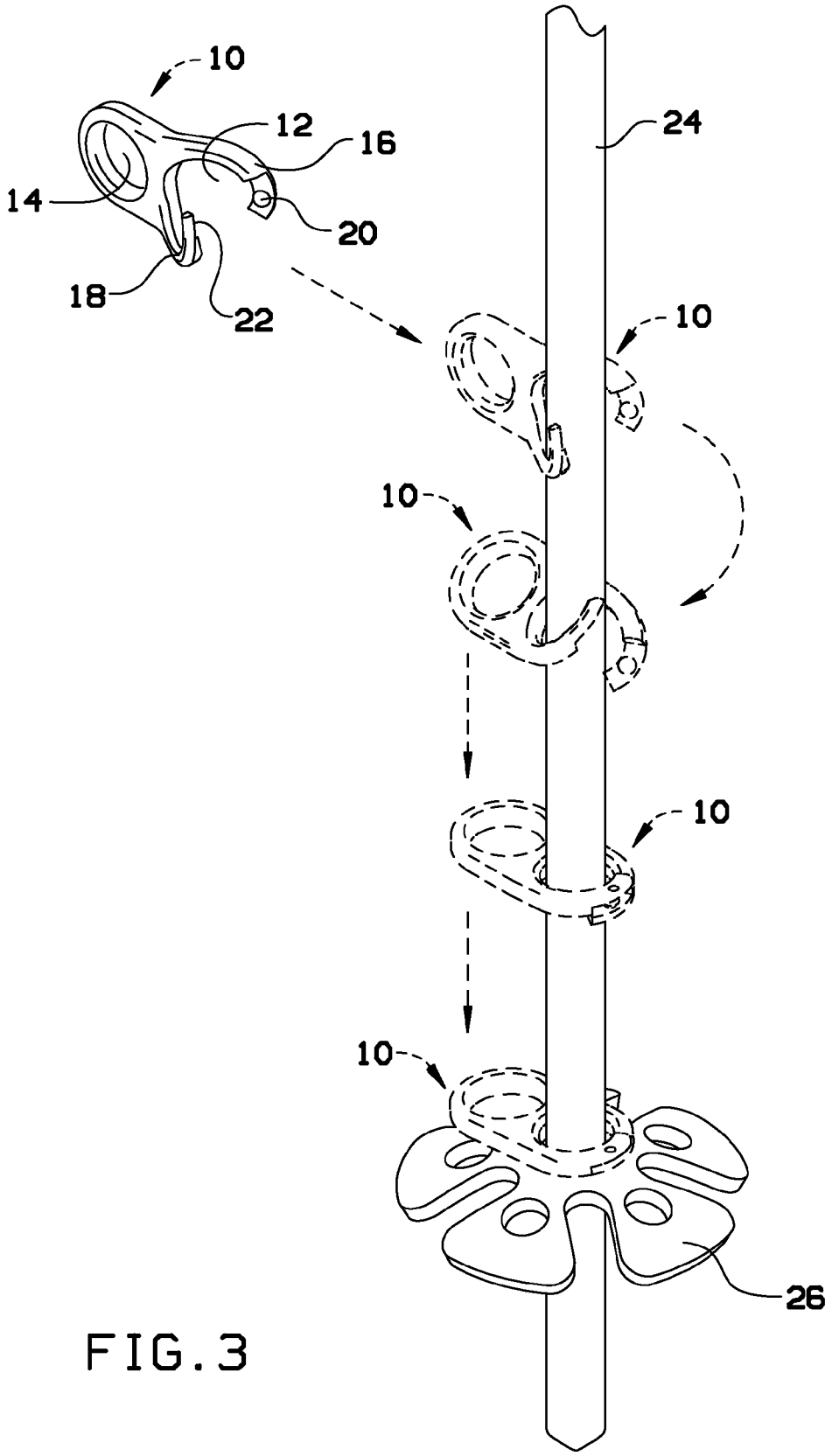
FIG. 3 is a perspective view of an exemplary embodiment of the present invention, illustrating the placement on a ski pole.
Figure 4:
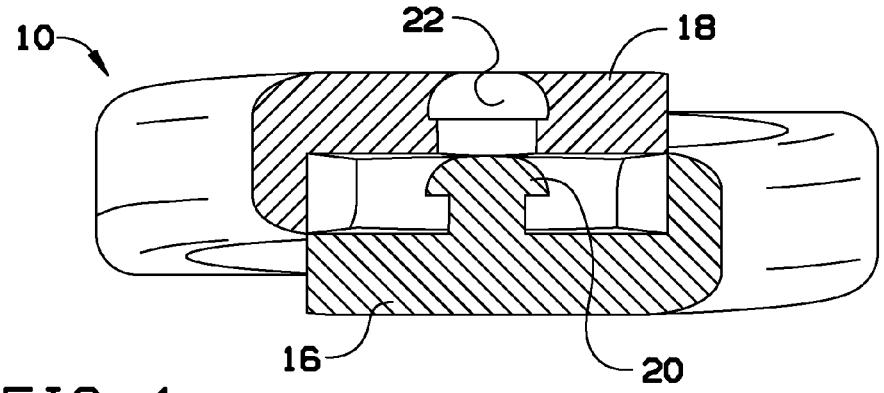
FIG. 4 is a section view of an exemplary embodiment of the present invention in the unlocked position, taken along line 4-4 in FIG. 2.
Figure 5:
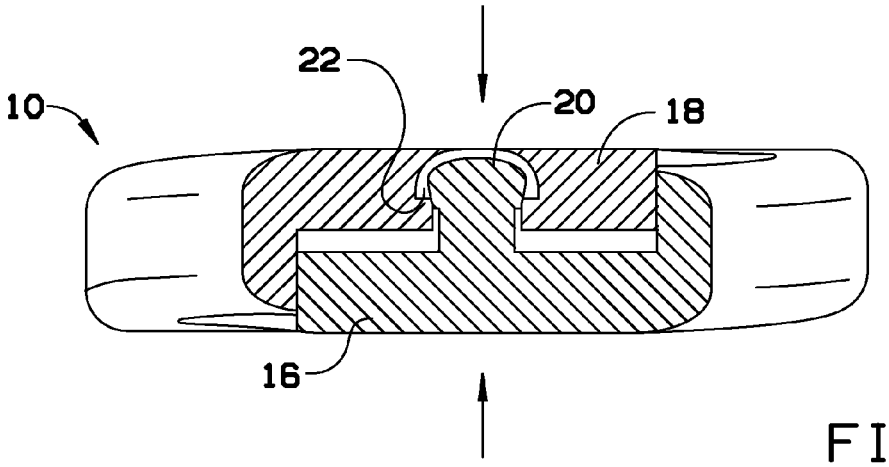
FIG. 5 is a section view of an exemplary embodiment of the present invention identifying the mushroom shaped locking device being engaged, illustrating the closure of the lock.
Figure 6:
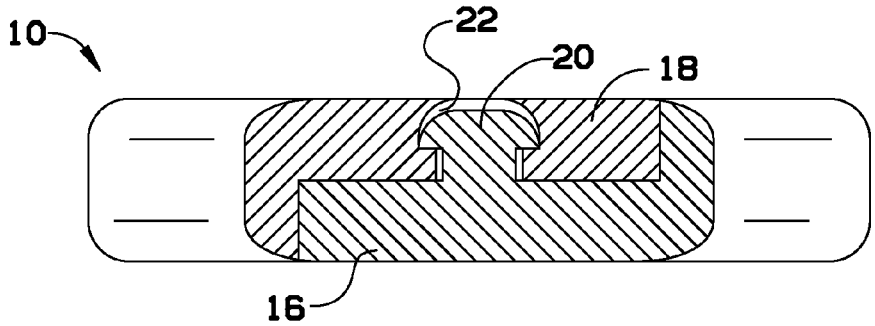
FIG. 6 is a section view of an exemplary embodiment of the present invention shown in a locked position, once locked, the device cannot be unlocked.

As is illustrated in FIGS. 1 through 6, the ski pole locking device 10 may include a pole ring 12 and a lock ring 14. The lock ring 14 may be a solid, closed ring configuration. In certain embodiments, a lock cable 28 may be passed through the lock ring 14 in order to secure the device to a set of skis and/or any permanent object. The pole ring 12 may include a first moveable arm 16 and a second moveable arm 18. The first moveable arm 16 may include a catching mechanism 20. In certain embodiments, the catching mechanism 20 may be a button. The button may be mushroom shaped. The second moveable arm 18 may include a catching mechanism cavity 22. The catching mechanism cavity 22 may be in the shape of a button, and in certain embodiments, the button is mushroom shaped. The pole ring may have a closed configuration and an open configuration. The closed configuration may have the catching mechanism 20 engaged with the catching mechanism cavity 22. Once the pole ring is put on the ski pole and the catching mechanism 20 and the catching mechanism cavity 22 are engaged creating the closed configuration, the ski pole locking device may not be removed from the ski pole. The open configuration may have the catching mechanism 20 separated from the catching mechanism cavity 22. The first moveable arm 16 and the second moveable arm 18 of the pole ring 12 may spread around a ski pole 24 while in the open configuration. Once the pole ring 12 may be situated around the ski pole 24, the pole ring 12 may be placed in the closed configuration as is shown in FIG. 3. Once in the closed configuration, the pole ring 12 may rest near a basket 26 of the ski pole 24. The ski pole locking device 10 may stay in that position while not in use.

A method of using the ski pole locking device may include the following: attaching the ski pole locking device to a ski pole by opening the pole ring around the ski pole and then closing the pole ring of the ski pole locking device. Once attached to the ski pole, the locking device cannot be removed. While not in use, the ski pole locking device may remain near the bottom of the ski pole near the basket. When ready to use, an individual may slide the ski pole locking device up the ski pole to a desired height. A ski lock cable may be placed through the hole of the lock ring. An individual may then secure the ski lock cable to the individual's skis and any permanent object. Again, after use, the individual may unlock the ski poles and let the ski pole locking device fall down towards the basket of the ski pole until ready to be used again.

It should be understood, of course, that the foregoing relates to exemplary embodiments of the invention and that modifications may be made without departing from the spirit and scope of the invention as set forth in the following claims.

What is claimed is:

1. A ski pole locking device comprising:

a pole ring comprising a first moveable arm and a second moveable arm, wherein the first moveable arm comprises a button head, wherein the second moveable arm comprises a button head cavity, wherein the pole ring comprises a closed configuration and an open configuration, wherein the closed configuration comprises the button head circumscribed by the button head cavity, wherein the open configuration comprises a non-planar unlocked position of an upper edge of the first movable arm and an upper edge of the second moveable arm, wherein the button head is not circumscribed by the button head cavity;

a fixed hole provided by the second movable arm, the fixed hole communicating to the button head cavity;

the button head having a curved surface and a flat surface, and wherein the button head is deformable between a non-deformed condition and a deformed condition by urging the curved surface against the fixed hole, and wherein the fixed hole is dimensioned to not receive the non-deformed condition; and a lock ring comprising a closed ring configuration.

2. The ski pole locking device of claim 1, wherein the closed configuration is permanent.

3. The ski pole locking device of claim 1, further comprising a lock cable threaded through the lock ring.

4. A method of preparing a ski pole to be permanently locked to an object, comprising:

providing a ski pole locking device comprising:

a pole ring having a first moveable arm and a second moveable arm, wherein the first moveable arm comprises a resilient button head, wherein the second moveable arm comprises a button head cavity, wherein the pole ring provides a closed configuration and an open configuration, wherein the closed configuration comprises the resilient button head permanently engaged in the button head cavity, wherein the open configuration comprises a non-planar position of an upper edge of the first movable arm and an upper edge of the second moveable arm, wherein the resilient button head is separated from head cavity, and a lock ring comprising a closed ring configuration;

spreading the first and second moveable arms fully around a ski pole; and urging the resilient button head to a deformed condition so as to pass the resilient button head into the button head cavity; and residing the resilient button head in the button head cavity, wherein the resilient button head springs back to a non-deformed condition, permanently engaging the closed configuration.

5. The method of claim 4, wherein the pole ring cannot be moved to the open configuration once the closed configuration has been provided.

* * * * *